United States Patent [19]

LaCombe

[11] 4,006,479

[45] Feb. 1, 1977

[54] METHOD FOR DISPERSING METALLIC PARTICLES IN A DIELECTRIC BINDER

[75] Inventor: Donald J. LaCombe, De Witt, N.Y.

[73] Assignee: The United States of America as represented by the Secretary of the Air Force, Washington, D.C.

[22] Filed: Feb. 4, 1969

[21] Appl. No.: 798,263

[52] U.S. Cl. ..... 343/18 A; 252/62.55

[51] Int. Cl.[2] ..... H01Q 17/00

[58] Field of Search ..... 252/62.55; 343/18 A

[56] References Cited

UNITED STATES PATENTS

| | | | |
|---|---|---|---|
| 2,330,590 | 9/1943 | Kaschke | 252/62.55 X |
| 2,610,250 | 9/1952 | Wheeler | 343/18 A |
| 2,954,552 | 9/1960 | Halpern | 343/18 A |
| 3,185,986 | 5/1965 | McCaughna et al. | 343/18 A |

*Primary Examiner*—T.H. Tubbesing

*Attorney, Agent, or Firm*—Joseph E. Rusz; William J. O'Brien

[57] ABSTRACT

A method for accomplishing the uniform distribution of finely divided metallic particles throughout a dielectric binder material. The finely divided metal particles are first admixed with a finely divided dielectric material and then further mixed with a powdered organic resinous binder. The composite mixture is further processed by hot compression molding of the admixed powders to form a radar energy absorbing material.

6 Claims, No Drawings

METHOD FOR DISPERSING METALLIC PARTICLES IN A DIELECTRIC BINDER

BACKGROUND OF THE INVENTION

This invention relates to a method for dispersing finely divided metal particles in a binder material. In a more particular manner, this invention concerns itself with a method for effecting the uniform distribution of sub-micron size electrically conducting or magnetic metal particles throughout an organic resinous binder.

The problem of providing an adequate method for the uniform dispersion of sub-micron size metal particles in a plastic binder material is well known. Because of their very small size, the metal particles tend to agglomerate or cluster together due to the mutual electrostatic forces which exist between them. The particles form clusters of critical size such that the electrostatic forces of attraction are balanced by the forces tending to separate them. In attempting to disperse these particles within a binder material, it has often been found to be very difficult to break up these clusters and keep them separated until the binder has solidified. The problem is very well known in the manufacture of paint where the paint pigments must be evenly dispersed in the binder in order to be effective. The paint manufacturing industry has solved the problem by the proper choice of binders and by a milling operation which breaks up the pigment clusters. Since the binder molecules themselves have a significant dipole moment, once the clusters are broken up in milling and become coated with the binder molecules, the mutual electrostatic forces between the particles are relieved and cluster formation is retarded.

The problem of effectively dispersing finely divided particles is also encountered in the fabrication of radiation absorbing materials. In such applications, it is most desirable that the composite materials have as low a dielectric constant as possible so that the impedance match of the material to free space is as good as possible. In addition, these materials often consist of either electrically conducting or magnetic particles dispersed throughout a binder material. The dielectric constant of the composite mixture of conducting particles and binder is a sensitive function of the particles separation and, therefore, it is critical that an adequate and effective dispersion be attained.

In the formation of radar absorbing materials, the binder component must also have a low dielectric constant. Therefore, the method employed in the dispersion of paint pigments which involves the use of a binder with a large dipole moment cannot be utilized in solving the dispersion problem encountered in the fabrication of a radar absorbing material.

In attempting to overcome the problem of providing for the uniform dispersion of finely divided metal particles in a plastic binder, it has been found that a uniform and effective dispersion of the metal particles can be accomplished by first admixing the particles with a finely divided insulating powdered material and then further mixing the admixture with a resinous, dielectric binder material which is likewise in finely divided form. The resulting dielectric constant of the composite mixture has been found to be considerably lower than that achieved by the method in which the metal particles are mechanically blended with the dielectric plastic binder.

SUMMARY OF THE INVENTION

In accordance with this invention, the uniform dispersion of sub-micron sized electrically conducting or magnetic metal particles within a dielectric resinous material can be effectively accomplished by first admixing the metal particles with a finely divided dielectric material in a conventional blender. The admixture is then further mixed in the same blender with a powdered, resinous dielectric binder material. The composite mixture is then subjected to a conventional hot compression molding process to form a solid radar energy absorbing component.

Accordingly, the primary object of this invention is to provide a method for the uniform dispersion of finely divided metal particles throughout a dielectric binder material.

Another object of this invention is to provide a method for significantly reducing the dielectric constant of a composite material composed of finely divided electrically conducting particles dispersed within a resinous, electrically insulating binder material.

Still another object of this invention is to provide a method for producing a composite material that is particularly useful as a magnetic radar absorber and is composed of finely divided magnetic particles dispersed within a resinous dielectric binder.

The above and still further objects and advantages of this invention will become readily apparent after giving due consideration to the following detailed description thereof.

DESCRIPTION OF THE PREFERRED EMBODIMENTS

Pursuant to the above objects of this invention, the present method involves a technique for dispersing sub-micron sized metallic particles in a plastic binder in such a way that the dielectric constant of the composite is significantly reduced below that obtained when the particles and the binder are mechanically mixed. The metallic particles are first mixed with a finely divided dielectric material in a conventional blender. A desirable dielectric material for use with this method is an ultra-fine silicon dioxide with a particle size of 0.007 microns. However, it should be pointed out that the specific material used is not essential to the method as long as the material is a dielectric and finely divided. After the first mixing step, the resulting mixture is then mixed with a resinous binder, also in powder form. The second mixing step is likewise accomplished in a conventional blender. A particularly useful binder material is polystyrene. The composite mixture is then hot compression molded to form a solid radar energy absorbing component.

In mixing the metal powder with the finely divided dielectric material, the action of the blender breaks up the clusters of metal particles and intimately mixes them with dielectric particles. New clusters are formed, but they contain both conducting and insulating particles. Therefore, the average metal particle separation within the clusters is increased, resulting in a lower dielectric constant for the composite. The dielectric constant will be a function of the relative volume loadings of metal particles, insulating particles, and binder. For a fixed metal volume loading, the dielectric constant will be minimized as the volume loading of the insulating particles is maximized. Since the volume loading of binder decreases as that of the insulating particles increases, the maximum loading of insulating particles corresponds to that beyond which the composite becomes physically unsound due to insufficient binder.

With the foregoing discussion in mind, there is presented herewith detailed examples which will illustrate to those skilled in the art the manner in which this invention is carried out. The examples disclose magnetic radar absorbing materials which have been prepared in accordance with the concept of this invention and involve the dispersion of the very fine iron particles of polystyrene.

The results are presented in Tables I and II. In Table I, three different examples are listed, each of which has a weight loading of iron particles of 55 percent. The loading of silicon dioxide varied from zero percent to 20 percent. As indicated, the dielectric constant decreased from about 58 for the zero percent silicon dioxide sample to 18 for the 20 percent silicon dioxide sample even though the volume loading of iron increased from 18 percent to 23 percent. This 20 percent loading of silicon dioxide corresponded to the maximum practical loading consistent with a physically sound example of a radar energy absorbing component.

In Table II, three more samples are listed, each of which has a 40 percent weight loading of iron particles. Because of the lower iron loading, it was possible to obtain a higher silicon dioxide loading and the dielectric constant was reduced from 16 to 5.71. For each weight loading of iron the dielectric constant was reduced by a factor of approximately three through the use of the silicon dioxide and the technique described above.

TABLE I

DISPERSION EXPERIMENT
55% WEIGHT LOADING OF IRON PARTICLES

| Sample | Iron Volume Loading | $SiO_2$ Weight Loading | Dielectric Constant |
|---|---|---|---|
| 1 | 18.6% | 0% | 57.96 |
| 2 | 20.8% | 10% | 25.92 |
| 3 | 23.5% | 20% | 18.16 |

TABLE II

DISPERSION EXPERIMENT
40% WEIGHT LOADING OF IRON PARTICLES

| Sample | Iron Volume Loading | $SiO_2$ Weight Loading | Dielectric Constant |
|---|---|---|---|
| 1 | 11% | 0% | 15.74 |
| 2 | 13.3% | 20% | 12.16 |
| 3 | 16.8% | 40% | 5.71 |

From the foregoing description, it will be apparent that the present invention provides a novel method for effecting a uniform dispersion of finely divided electrically conducting or megnetic particles within a binder material. The resulting dielectric constant of the metal powder containing composite is significantly reduced when compared to the dielectric constants of conventionally fabricated metal powder containing dielectric materials.

The invention has been described with particular reference to specific embodiments thereof. It is to be understood, however, that the present invention is for the purpose of illustration only and it is not intended to limit the invention in any way since the scope thereof is defined by the appended claims.

What is claimed is:

1. A method for dispersing sub-micron sized, finely divided metal particles through a solid, resinous, dielectric binder material comprising the step of admixing the finely divided metal particles with a powdered dielectric material, mixing the resulting admixture with a powdered resinous binder to form a composite mixture, and heating and compressing the composite mixture to form a solid, homogeneous dielectric body with finely divided metal particles evenly dispersed therein.

2. A method in accordance with claim 1 wherein said dielectric material is silicon dioxide and said binder material is polystyrene.

3. A method in accordance with claim 1 wherein said metal particles are iron.

4. A radar energy absorbing material comprising a solid, homogeneous blend of sub-micron sized, finely divided metal particles, a finely divided dielectric material and a resinous binder.

5. A radar energy absorbing material in accordance with claim 4 wherein said metal is iron.

6. A radar energy absorbing material in accordance with claim 4 wherein said dielectric material is silicon dioxide and said resinous binder is polystyrene.

* * * * *